US011545766B2

(12) United States Patent
Nagata

(10) Patent No.: US 11,545,766 B2
(45) Date of Patent: Jan. 3, 2023

(54) TERMINAL BLOCK

(71) Applicant: Yazaki Corporation, Tokyo (JP)

(72) Inventor: Daiki Nagata, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 38 days.

(21) Appl. No.: 17/237,225

(22) Filed: Apr. 22, 2021

(65) Prior Publication Data

US 2021/0336359 A1 Oct. 28, 2021

(30) Foreign Application Priority Data

Apr. 22, 2020 (JP) ..... JP2020-076001

(51) Int. Cl.
*H01R 9/24* (2006.01)
*H01R 9/18* (2006.01)
*H01R 11/12* (2006.01)

(52) U.S. Cl.
CPC ..... *H01R 9/24* (2013.01); *H01R 9/18* (2013.01); *H01R 11/12* (2013.01)

(58) Field of Classification Search
CPC . H01R 4/34; H01R 4/302; H01R 9/18; H01R 9/24; H01R 11/12
See application file for complete search history.

(56) References Cited

U.S. PATENT DOCUMENTS 6,464,538 B2 * 10/2002 Miyazaki ..... H01R 13/6589 439/95
6,702,612 B2 * 3/2004 Miyazaki ..... H01R 13/74 439/559
7,811,116 B2 * 10/2010 Sakakura ..... H01R 4/302 439/364
8,152,574 B2 * 4/2012 Matsuoka ..... H01R 4/302 439/587
10,062,974 B2 * 8/2018 Okamoto ..... H01R 4/30
10,468,792 B2 * 11/2019 Yamamoto ..... H01R 9/2416
2018/0337471 A1 * 11/2018 Yamamoto ..... H01R 9/2416

FOREIGN PATENT DOCUMENTS

JP 2013-58332 A 3/2013
JP 6603264 B2 11/2019

* cited by examiner

*Primary Examiner* — Oscar C Jimenez
(74) *Attorney, Agent, or Firm* — Sughrue Mion, PLLC

(57) ABSTRACT

A terminal block includes a pedestal and a terminal attached to the pedestal. A fastening portion of a connection terminal is overlapped on a fixing face of the terminal and is fastened to a fastening position on the fixing face. The connection terminal is brought close to and disposed at the fastening position of the terminal from a side. The pedestal has a guide face that guides the fastening portion of the connection terminal that approaches from a side upward from the fixing face toward the fastening position. The fastening portion passes beyond an edge portion of the guide face and arrives at the fastening position so as to be overlapped on the fixing face.

3 Claims, 10 Drawing Sheets

TERMINAL BLOCK

CROSS-REFERENCE TO RELATED APPLICATIONS

This application is based on and claims priority under 35 USC 119 from Japanese Patent Application No. 2020-076001 filed on Apr. 22, 2020, the contents of which are incorporated herein by reference.

TECHNICAL FIELD

The present invention relates to a terminal block.

BACKGROUND ART

Patent Literature 1 discloses a terminal block that includes a terminal to which a counterpart terminal is fastened on an upper face of the terminal. The terminal block is provided with a pair of guide walls disposed in protrusion. An upper front corner portion of each of the guide walls is obliquely cut off from the upper face to a front face. A terminal tip end of the terminal in a central portion in a width direction of the terminal is curved from the upper face along the front face in a manner of being hidden between the guide walls.

CITATION LIST

Patent Literature

Patent Literature 1: JP-A-2013-58332

SUMMARY OF INVENTION

In a structure in which the counterpart terminal is fastened to the upper face of the terminal of the terminal block by a bolt and a nut, when the counterpart terminal is fastened to the terminal block from a side, the counterpart terminal may slip under the terminal of the terminal block, or the counterpart terminal may come into contact with an end face of the terminal and the counterpart terminal may be deformed.

According to the terminal block disclosed in Patent Literature 1, since the central portion in the width direction of the terminal is curved and enters between the guide walls, the counterpart terminal can be prevented from slipping to a rear side of the terminal and the counterpart terminal can be prevented from coming into contact with the end face of the terminal by guiding the counterpart terminal in an appropriate direction.

However, the terminal block disclosed in Patent Literature 1 has a complicated structure in which the pair of guide walls protrude from a terminal block body, a narrow portion is formed at the center in the width direction of the terminal in accordance with an interval between the guide walls, and the narrow portion is bent to be inserted between the guide walls. Therefore, costs of the terminal block are increased. In addition, in the terminal block, end faces at both sides of the narrow portion in the center of the terminal are disposed above the guide walls and are exposed at the front side. Therefore, in portions where the end faces are exposed at both sides of the narrow portion of the terminal, the counterpart terminal provided from a side may slip between the terminal and a pedestal, or may come into contact with the end faces.

The present invention has been made in view of the above circumstances, and an object of the present invention is to provide a terminal block capable of smoothly guiding a counterpart terminal to a fastening position and fastening the counterpart terminal while preventing an increase in costs.

In order to achieve the above object, the present invention has the following configurations. A terminal block of the present invention includes a pedestal and a terminal attached to the pedestal. A fastening portion of a counterpart terminal is overlapped on a fixing face of the terminal and is fastened to a fastening position on the fixing face. The counterpart terminal is brought close to and disposed at the fastening position of the terminal from a side. The pedestal has a guide face that guides the fastening portion of the counterpart terminal that approaches from a side upward from the fixing face toward the fastening position. The fastening portion passes beyond an edge portion of the guide face and arrives at the fastening position so as to be overlapped on the fixing face.

DESCRIPTION OF EMBODIMENTS

Hereinafter, an example of an embodiment according to the present invention will be described with reference to the drawings.

Figure 1:
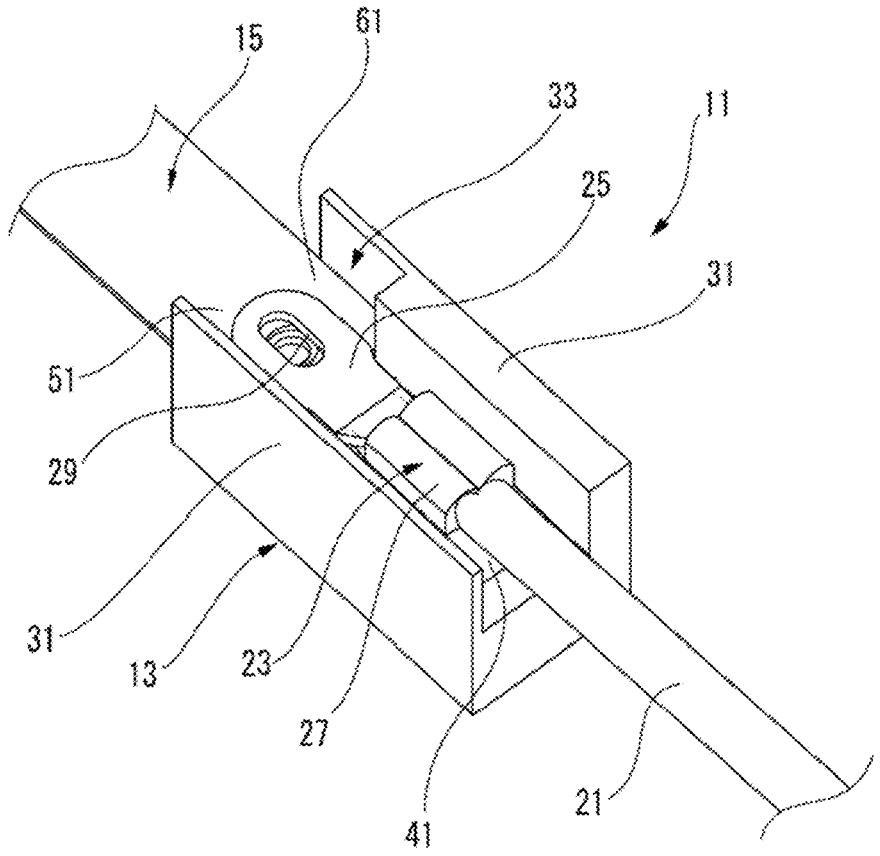
FIG. 1 is a perspective view showing a terminal block according to a first embodiment of the present invention.
Figure 2:
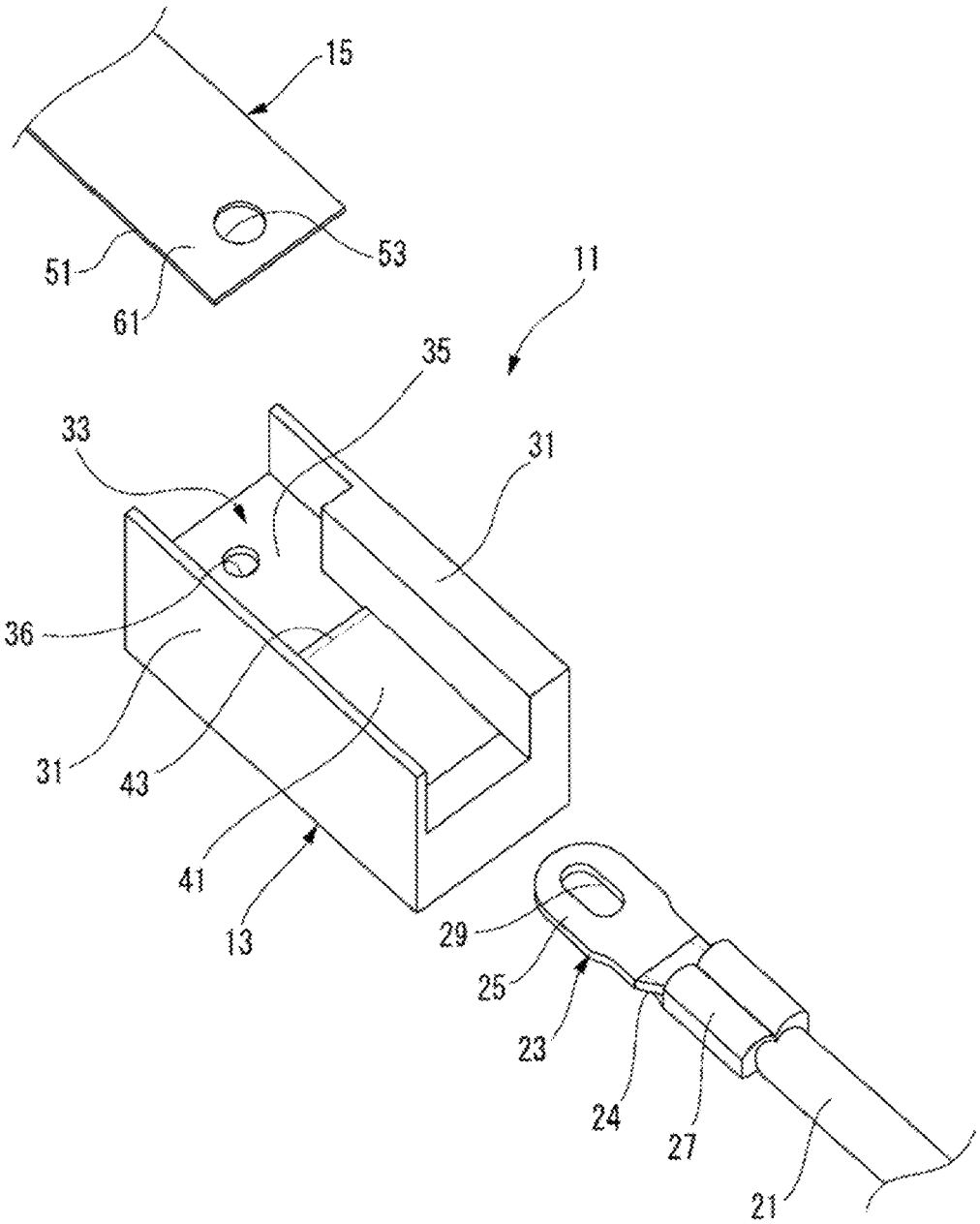
FIG. 2 is an exploded perspective view showing the terminal block according to the first embodiment.
Figure 3A:
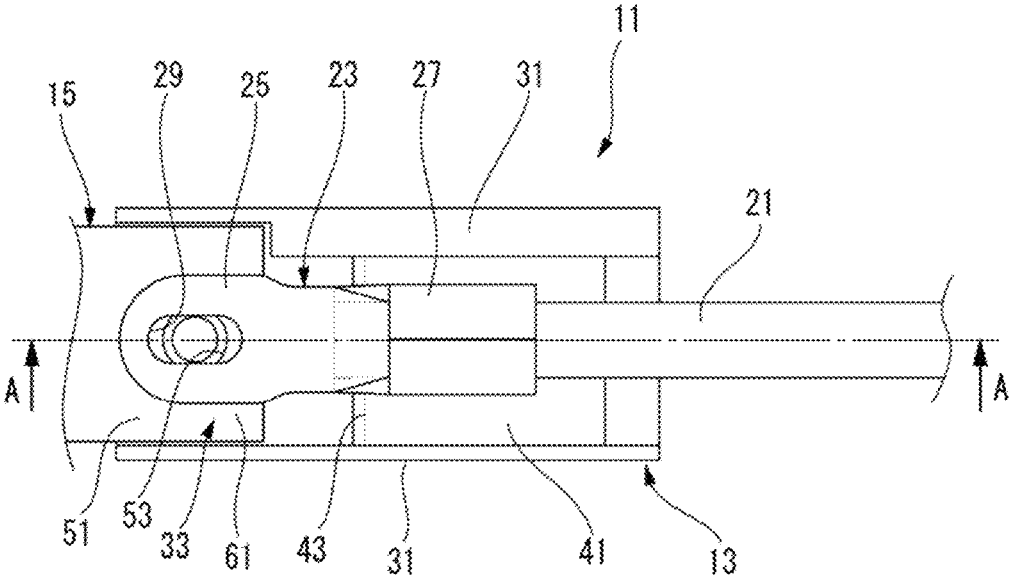
FIG. 3A is a plan view showing the terminal block.
Figure 3B:
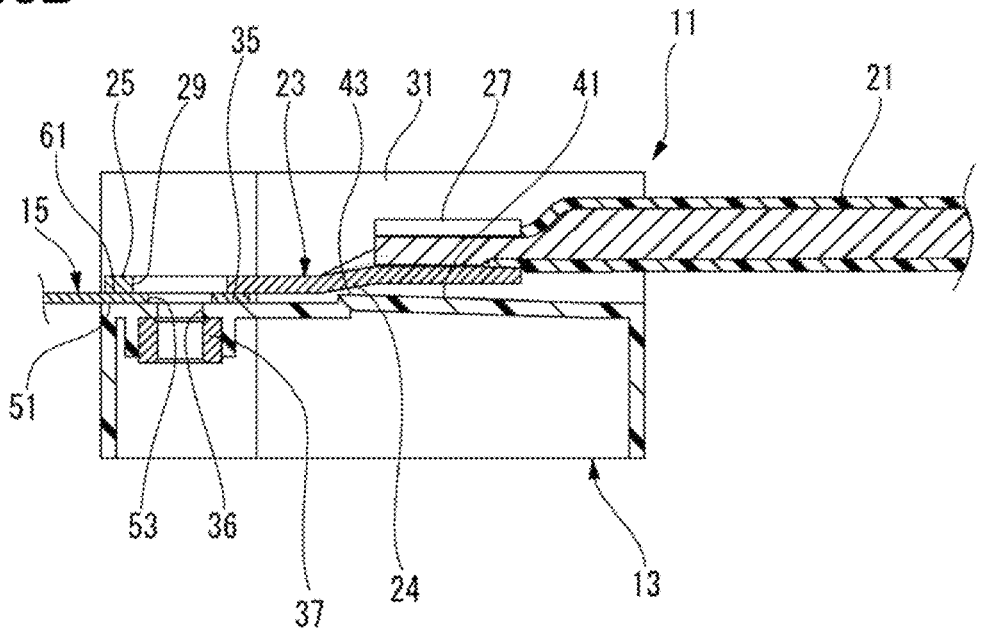
FIG. 3B is a cross-sectional view taken along a line A-A in FIG. 3A.

FIG. 1 is a perspective view showing a terminal block 11 according to a first embodiment of the present invention. FIG. 2 is an exploded perspective view showing the terminal block 11 according to the first embodiment. FIG. 3A is a plan view showing the terminal block 11, and FIG. 3B is a cross-sectional view taken along a line A-A in FIG. 3A.

As shown in FIGS. 1, 2, 3A, and 3B, the terminal block 11 according to the first embodiment includes a pedestal 13 and a terminal 15. A connection terminal 23 that is a counterpart terminal is provided at an end portion of an electric wire 21 and is fastened and fixed to the terminal block 11.

The pedestal 13 is molded from an insulating resin, and has an attachment portion 33 on an upper portion of the pedestal 13. The attachment portion 33 is formed into a groove shape defined by a plurality of side walls 31. An upper face of the attachment portion 33 serves as an attachment face 35, and the terminal 15 is assembled to the attachment face 35. A nut member 37 is embedded and fixed inside the attachment portion 33. A fastening bolt (not shown) passing through a through hole 36 of the attachment portion 33 is fastened to the nut member 37.

The terminal 15 assembled to the attachment portion 33 is formed of a conductive metal material such as copper and a copper alloy, and the terminal 15 is a plate-shaped busbar. The terminal 15 is assembled to the pedestal 13 from above. The terminal 15 includes a fixing plate portion 51 formed into a flat plate shape. The fixing plate portion 51 is placed on the attachment portion 33 of the pedestal 13, and is accommodated in the attachment portion 33 in a state where the fixing plate portion 51 is in contact with the attachment face 35. A bolt insertion hole 53 is formed in the fixing plate portion 51, and the bolt insertion hole 53 communicates with the through hole 36 and the nut member 37 that are provided in the attachment portion 33 in a state where the terminal 15 is accommodated in the attachment portion 33. An upper face of the fixing plate portion 51 serves as a fixing face 61 to which the connection terminal 23 is fastened and fixed.

One end side of the attachment portion 33 is a terminal mounting side, and a guide face 41 is formed at the terminal mounting side of the attachment portion 33. The guide face 41 is formed in a width direction of the attachment portion 33. The guide face 41 is an inclined face that is gradually inclined in a direction away from the fixing face 61 in a thickness direction of the fixing plate portion 51 of the terminal 15 toward the attachment portion 33. On the guide face 41, a position of an edge portion 43 at the attachment portion 33 side is higher than the fixing face 61 of the terminal 15.

Figure 4A:
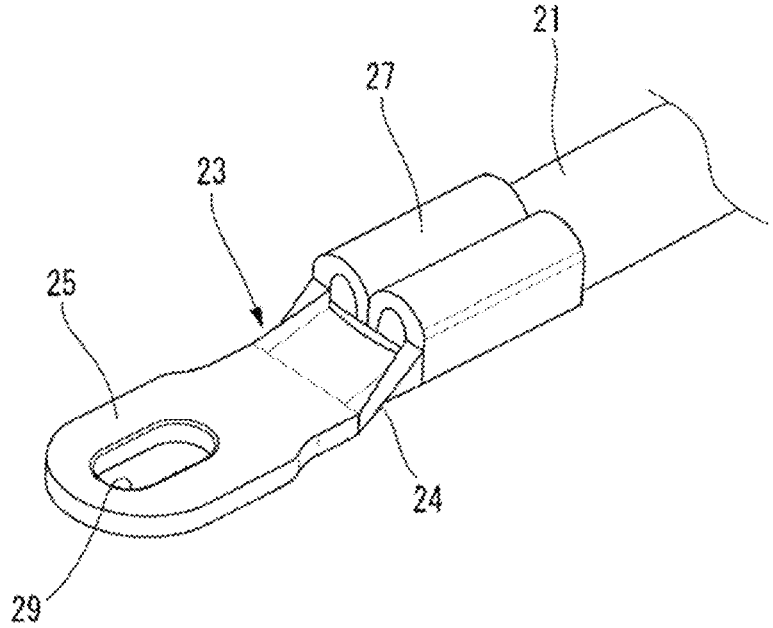
FIG. 4A is a perspective view showing a counterpart terminal connected to the terminal block as viewed from above.
Figure 4B:
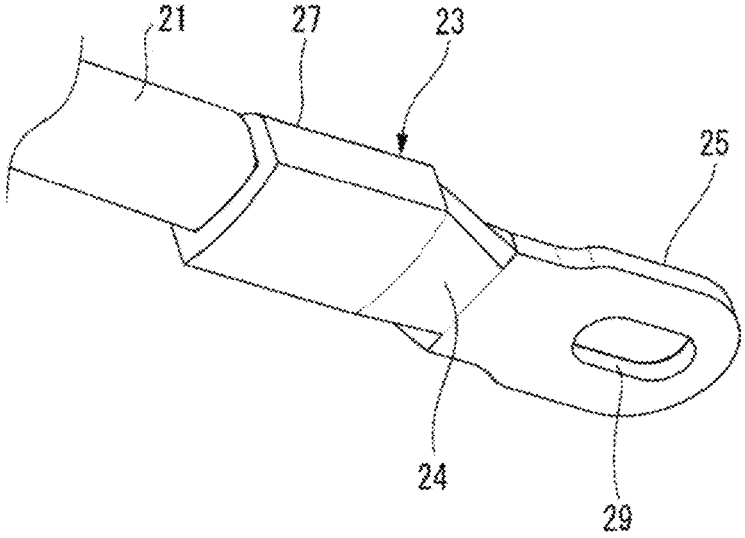
FIG. 4B is a perspective view showing the counterpart terminal connected to the terminal block as viewed from below.

FIG. 4A is a perspective view showing the connection terminal 23 connected to the terminal block 11 as viewed from above, and FIG. 4B is a perspective view showing the connection terminal 23 connected to the terminal block 11 as viewed from below.

The connection terminal 23 is a counterpart terminal to be connected to the terminal block 11. As shown in FIGS. 4A and 4B, the connection terminal 23 includes a fastening portion 25 formed into a plate shape and a crimping portion 27 to be crimped and connected to the electric wire 21. The fastening portion 25 is formed with a hole portion 29 that is an elongated hole through which a fastening bolt (not shown) is inserted.

Also, the counterpart terminal according to the present invention is not limited to the connection terminal 23 according to the present embodiment that is connected to an end portion of the electric wire 21, and may have various forms such as a busbar in which a conductive portion and a connection portion are integrated, and a single core wire having a tip formed into a terminal shape.

Portions of the connection terminal 23 other than the fastening portion 25, such as the crimping portion 27 and the electric wire 21, have smaller widths than the fastening portion 25. In addition, the fastening portion 25 is disposed in a direction away from an axis of the electric wire 21 compared with the crimping portion 27 to which the electric wire 21 is crimped and connected. As a result, a step 24 is formed between the fastening portion 25 and the crimping portion 27. Here, a height between the fixing face 61 of the terminal 15 and the edge portion 43 of the guide face 41 is smaller than the step 24 provided between the fastening portion 25 of the connection terminal 23 and the crimping portion 27 that is a portion other than the fastening portion 25.

The fastening portion 25 of the connection terminal 23 is disposed on the fixing face 61 of the fixing plate portion 51 of the terminal 15 provided in the terminal block 11, and a fastening bolt is inserted into the hole portion 29 formed in the fastening portion 25 and is screwed into the nut member 37. Then, the fixing plate portion 51 of the terminal 15 and the fastening portion 25 of the connection terminal 23 are fastened and fixed together by the fastening bolt and the nut member 37. As a result, the terminal 15 and the connection terminal 23 are electrically connected to each other.

Next, an example of fastening the connection terminal 23 to a fastening position on the fixing plate portion 51 of the terminal 15 in the terminal block 11 will be described.

Figure 5:
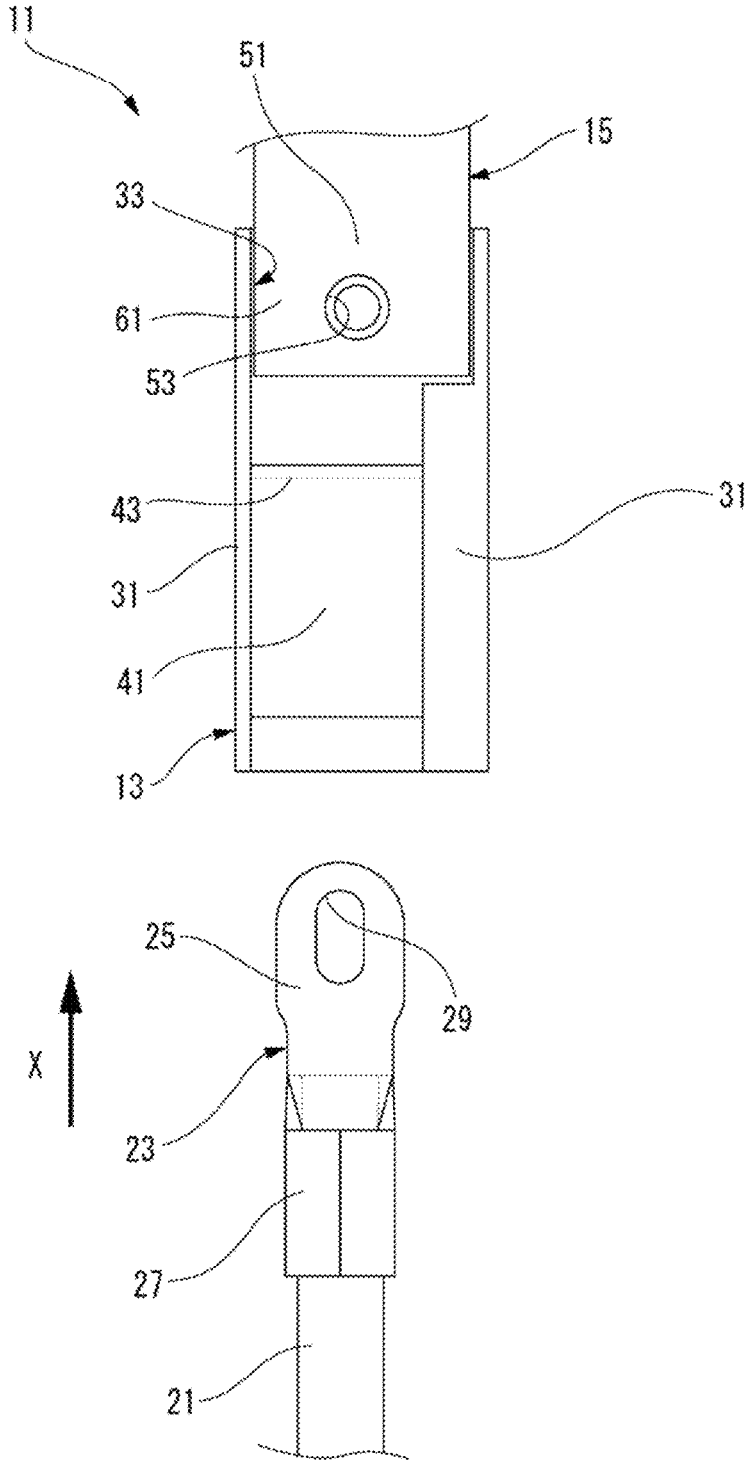
FIG. 5 is a plan view of the terminal block showing an arrangement example in which the counterpart terminal is brought close to the terminal block from a side.
Figure 6A:
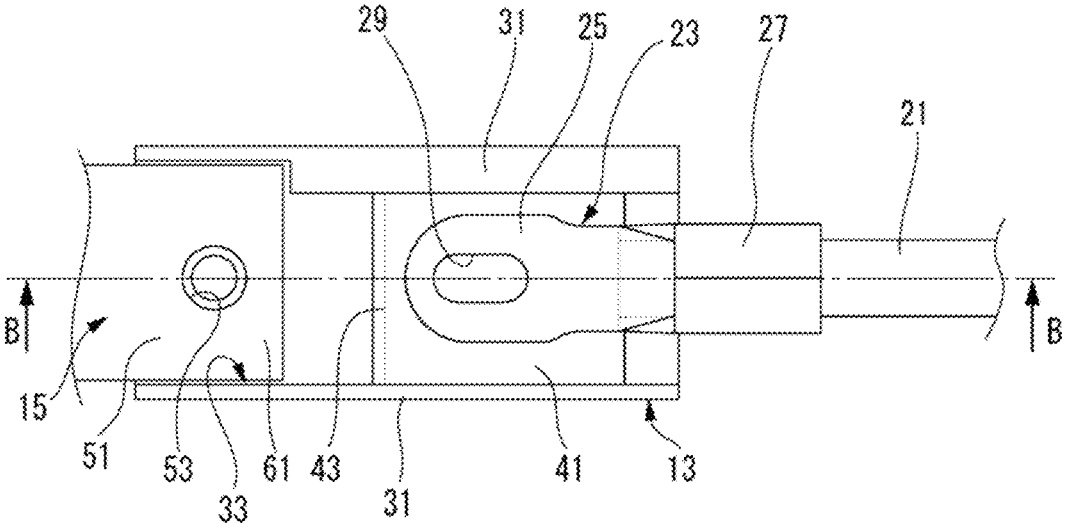
FIG. 6A is a plan view showing a process of connecting the counterpart terminal to the terminal block.
Figure 6B:
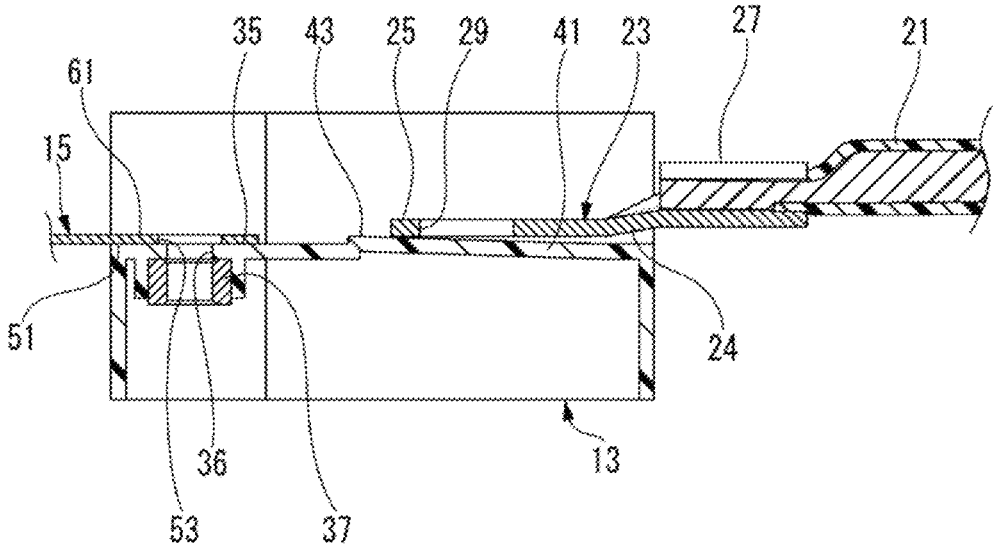
FIG. 6B is a cross-sectional view taken along a line B-B in FIG. 6A.
Figure 7A:
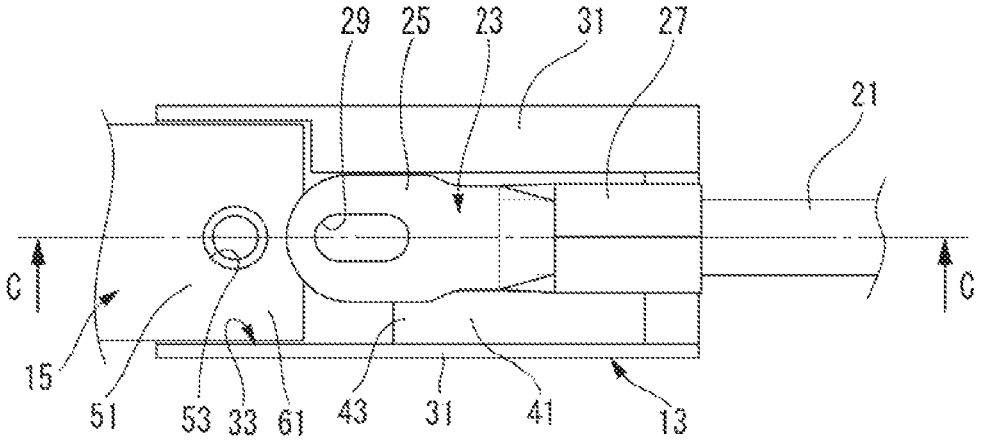
FIG. 7A is a plan view showing a process of connecting the counterpart terminal to the terminal block.
Figure 7B:
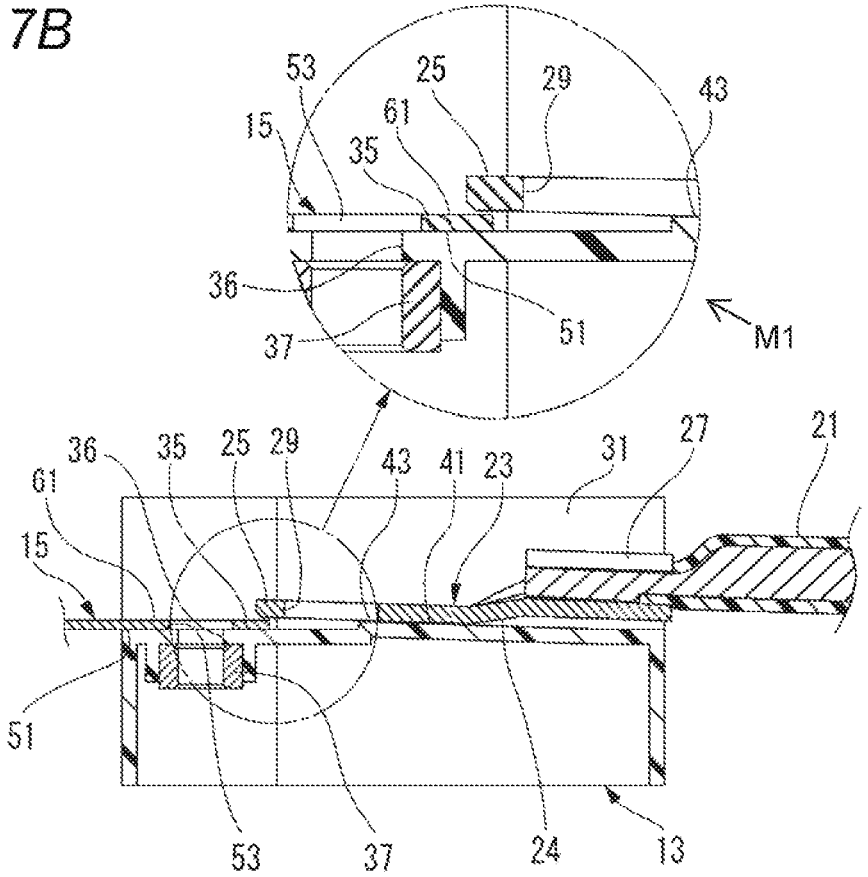
FIG. 7B is a cross-sectional view taken along a line C-C in FIG. 7A.
Figure 8A:
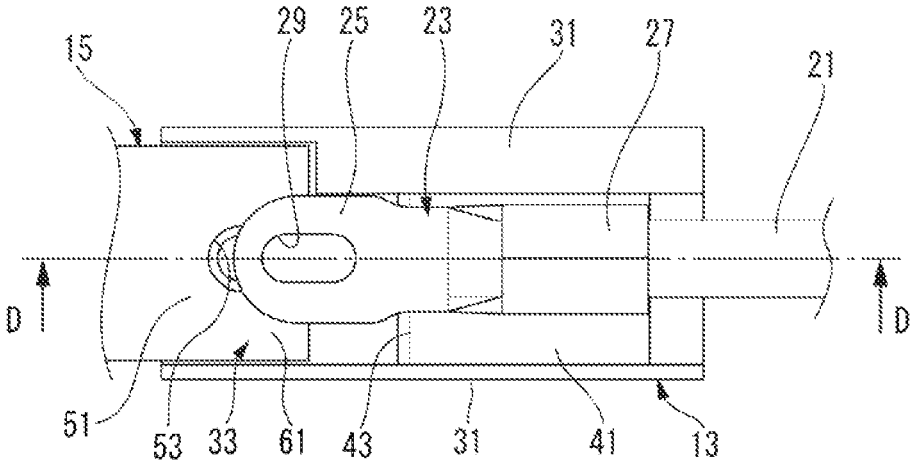
FIG. 8A is a plan view showing a process of connecting the counterpart terminal to the terminal block.
Figure 8B:
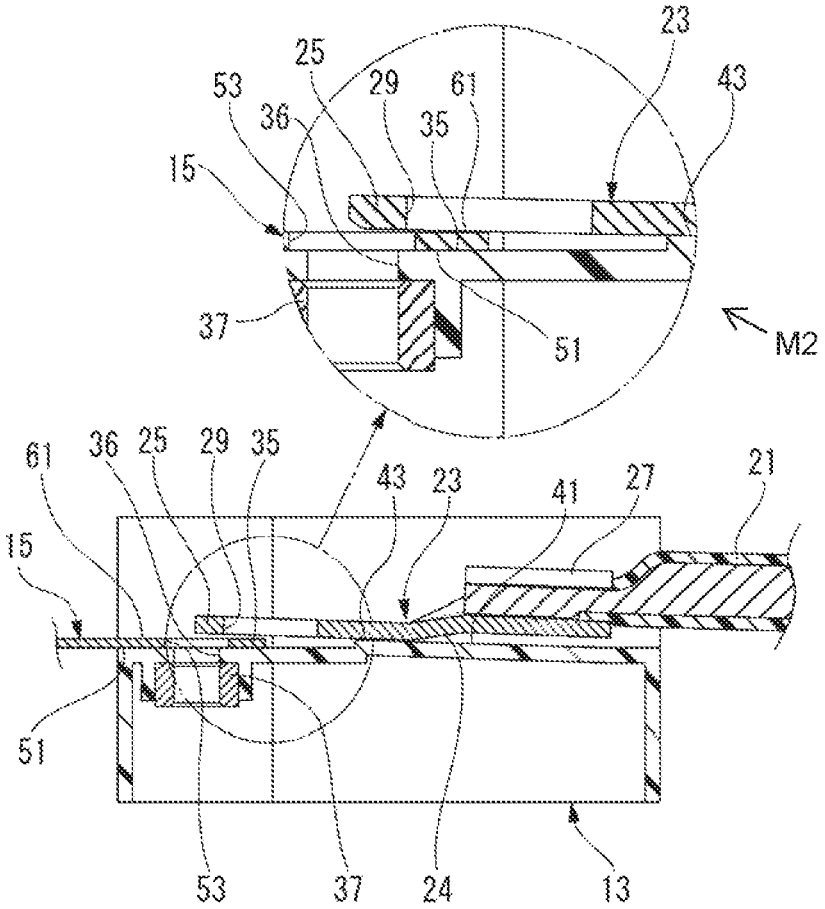
FIG. 8B is a cross-sectional view taken along a line D-D in FIG. 8A.

FIG. 5 is a plan view of the terminal block 11 showing an arrangement example in which the connection terminal 23 is brought close to the terminal block 11 from a side. FIG. 6A is a plan view showing a process of connecting the connection terminal 23 to the terminal block 11, and FIG. 6B is a cross-sectional view taken along a line B-B in FIG. 6A. FIG. 7A is a plan view showing a process of connecting the connection terminal 23 to the terminal block 11, and FIG. 7B is a cross-sectional view taken along a line C-C in FIG. 7A and shows a portion M1 magnified for illustration. FIG. 8A is a plan view showing a process of connecting the connection terminal 23 to the terminal block 11, and FIG. 8B is a cross-sectional view taken along a line D-D in FIG. 8A and shows a portion M2 magnified for illustration.

As shown in FIG. 5, for example, when a cover is provided above the terminal block 11 or when the terminal block 11 is installed in a narrow space of a vehicle, the connection terminal 23 has to be brought into contact with and inserted into the terminal block 11 from a side (see an arrow X direction in FIG. 5).

As described above, in a case where the connection terminal 23 is brought close to and inserted into the terminal block 11 from a side, when a height position of the fastening portion 25 of the connection terminal 23 is lower than the fixing plate portion 51 of the terminal 15, a tip end portion of the fastening portion 25 comes into contact with the guide face 41 of the pedestal 13, as shown in FIGS. 6A and 6B.

When the connection terminal 23 is further inserted, as shown in FIGS. 7A and 7B, a posture of the fastening portion 25 of the connection terminal 23 follows the inclination of the guide face 41 and is guided upward along the guide face 41. A tip end of the fastening portion 25 of the connection terminal 23 protrudes from the edge portion 43 of the guide face 41 and is disposed at a position above the fixing plate portion 51 of the terminal 15. That is, it is possible to prevent a problem that the fastening portion 25 of the connection terminal 23 comes into contact with an end face of the fixing plate portion 51 of the terminal 15 or slips between the fixing plate portion 51 of the terminal 15 and the attachment face 35 of the pedestal 13.

Thereafter, as shown in FIGS. 8A and 8B, the fastening portion 25 of the connection terminal 23 is further guided toward a position above the fixing plate portion 51 of the terminal 15.

When the fastening portion 25 passes beyond the guide face 41 and arrives at the fastening position, the connection terminal 23 is separated from the guide face 41 and is brought into contact with the fixing face 61 of the fixing plate portion 51 of the terminal 15 (see FIGS. 3A and 3B). Here, a height between the fixing face 61 of the terminal 15 and the guide face 41 is smaller than the step 24 provided between the fastening portion 25 of the connection terminal 23 and the crimping portion 27 that is a portion other than the fastening portion 25. Therefore, even when the fastening portion 25 of the connection terminal 23 arrives at the fastening position, is separated from the guide face 41, and is displaced toward the fixing plate portion 51 of the terminal 15, the crimping portion 27 and the electric wire 21 that are portions of the connection terminal 23 other than the fastening portion 25 do not interfere with the guide face 41. As a result, the connection terminal 23 is disposed in a state where the fastening portion 25 of the connection terminal 23 is in good contact with the fixing face 61 of the terminal 15.

When the connection terminal 23 is disposed at the fastening position, a fastening bolt is inserted into the hole portion 29 formed in the fastening portion 25 of the connection terminal 23 and is screwed into the nut member 37, and the fixing plate portion 51 of the terminal 15 and the fastening portion 25 of the connection terminal 23 are fastened and fixed.

As described above, according to the terminal block 11 in the first embodiment, the connection terminal 23 can be electrically connected to the terminal 15 by disposing and fastening the fastening portion 25 of the connection terminal 23 that is a counterpart terminal to the fastening position of the fixing face 61 of the terminal 15. Here, in a case where the connection terminal 23 is brought close to the terminal 15 from a side, the fastening portion 25 of the connection terminal 23 is guided above the fixing face 61 by the guide face 41, and is overlapped on the fixing face 61 when the fastening portion 25 passes beyond the edge portion 43 of the guide face 41 and arrives at the fastening position. Therefore, it is possible to prevent a problem that the fastening portion 25 of the connection terminal 23 comes into contact with an end face of the terminal 15 or slips between the terminal 15 and the pedestal 13, protect the terminal 15, and prevent an increase in costs due to formation of a chamfer or the like on the fastening portion 25 of the connection terminal 23.

In addition, the guide face 41 is a tapered face that is gradually inclined upward from the fixing face 61 toward the fastening position. Therefore, the fastening portion 25 of the connection terminal 23 is guided toward the fastening position while coming into contact with the guide face 41 formed into a tapered face gradually inclined upward from the fixing face 61 toward the fastening position. Accordingly, the fastening portion 25 of the connection terminal 23 can be smoothly guided to the fastening position while being prevented from coming into contact with an end face of the terminal 15.

A height between the fixing face 61 and the guide face 41 is smaller than the step 24 between the fastening portion 25 of the connection terminal 23 and the crimping portion 27 that is a portion other than the fastening portion 25. Therefore, when the fastening portion 25 of the connection terminal 23 is separated from the guide face 41 and is displaced toward the fixing face 61, the crimping portion 27, the electric wire 21, and the like, which are portions of the connection terminal 23 other than the fastening portion 25, can be prevented from interfering with the guide face 41. As a result, the fastening portion 25 of the connection terminal 23 disposed at the fastening position can be well overlapped with the fixing face 61 of the terminal 15, and a fastening work can be smoothly performed.

Next, a terminal block 11A according to a second embodiment of the present invention will be described.

Components the same as those of the terminal block 11 according to the first embodiment are denoted by the same reference numerals, and a description thereof will be omitted.

Figure 9:
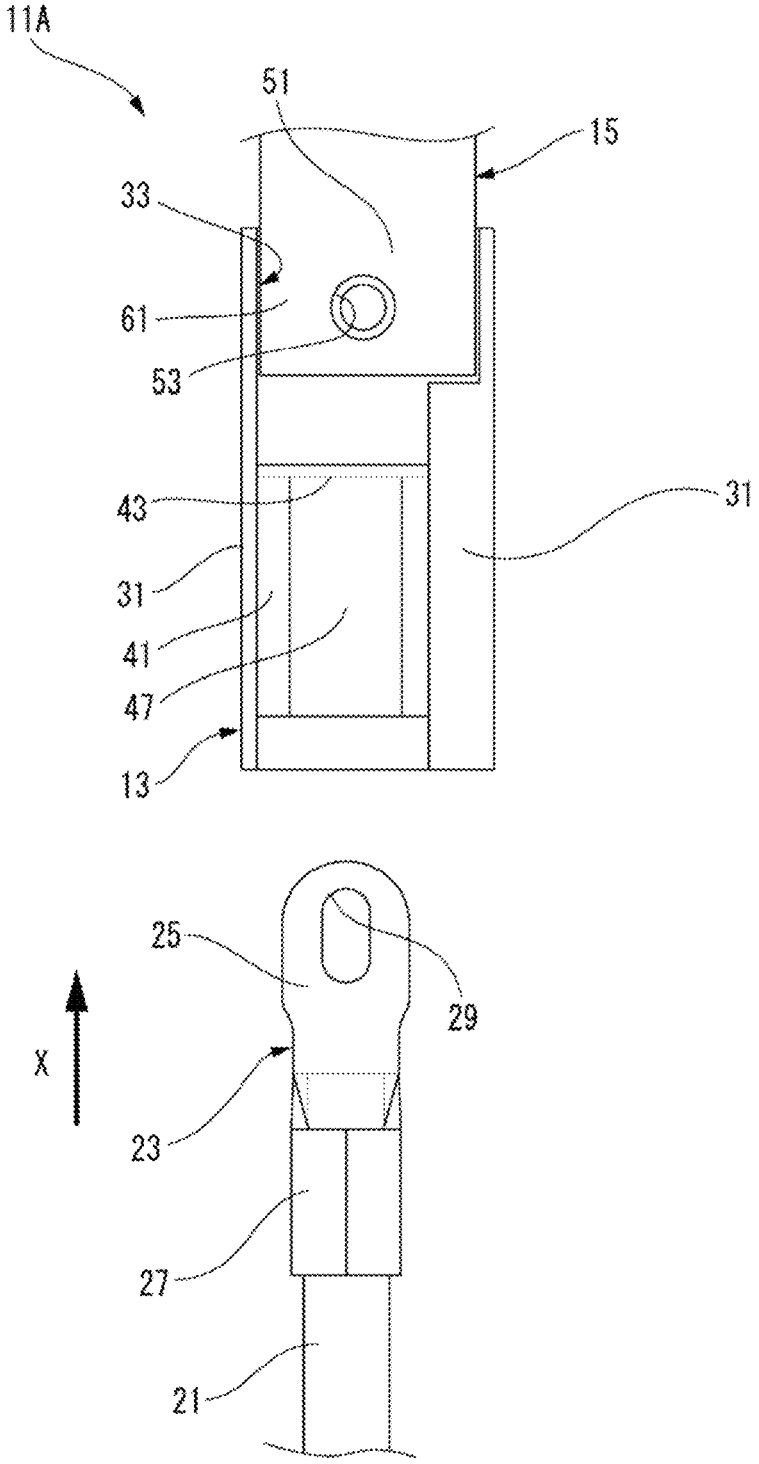
FIG. 9 is a plan view of a terminal block showing an arrangement example in which a counterpart terminal is brought close to the terminal block from a side according to a second embodiment of the present invention.
Figure 10A:
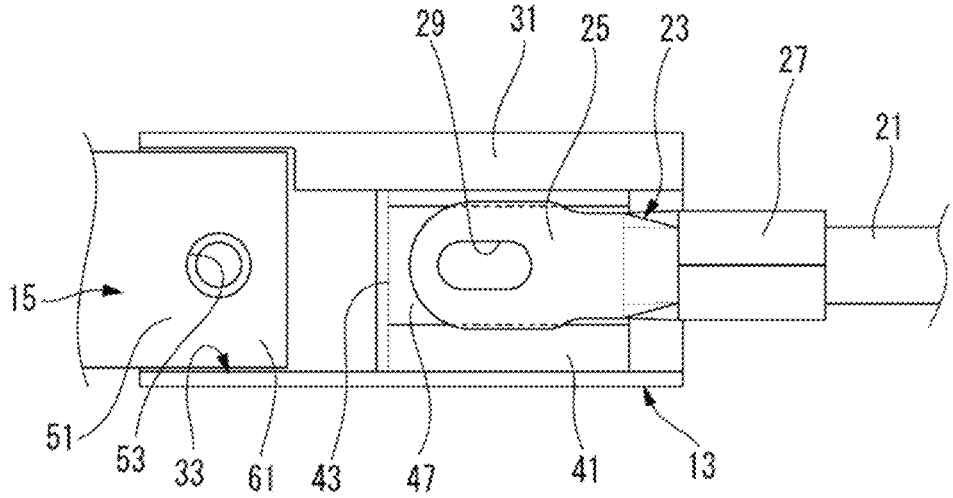
FIGS. 10A and 10B are plan views showing a process of connecting the counterpart terminal to the terminal block according to the second embodiment of the present invention.
Figure 10B:
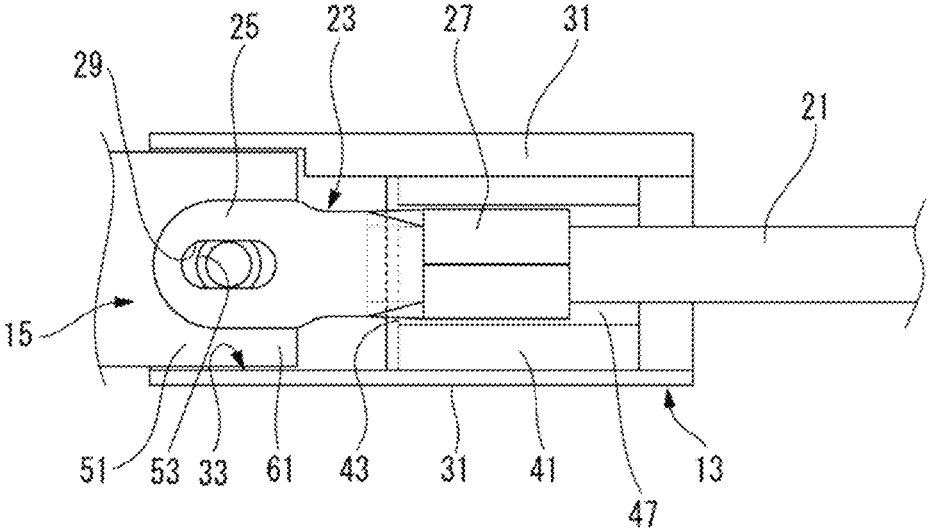

FIG. 9 is a plan view of the terminal block 11A showing an arrangement example in which the connection terminal 23 is brought close to the terminal block 11A from a side according to the second embodiment of the present invention. FIGS. 10A and 10B are plan views showing a process of connecting the connection terminal 23 to the terminal block 11A according to the second embodiment of the present invention.

As shown in FIG. 9, in the terminal block 11A according to the second embodiment, the guide face 41 is formed with an escape groove 47 along an insertion direction of the connection terminal 23. A width dimension of the escape groove 47 is smaller than a width dimension of the fastening portion 25 of the connection terminal 23, and is slightly larger than width dimensions of the crimping portion 27 and the electric wire 21 that are portions of the connection terminal 23 other than the fastening portion 25.

In the terminal block 11A according to the second embodiment, the connection terminal 23 is brought close to and inserted into the terminal 15, and the fastening portion 25 of the connection terminal 23 is guided upward along the inclination of the guide face 41, as shown in FIG. 10A. As shown in FIG. 10B, the connection terminal 23 is disposed at a fastening position on an upper face of the fixing face 61 of the fixing plate portion 51 of the terminal 15 without causing a problem that the connection terminal 23 comes into contact with an end face of the fixing plate portion 51 of the terminal 15 or slips between the fixing plate portion 51 of the terminal 15 and the attachment face 35 of the pedestal 13.

In this case, for example, even when no step 24 is formed in the connection terminal 23 and a lower face of the fastening portion 25 and a lower face of the crimping portion 27 to which the electric wire 21 is crimped and connected are flush with each other, the crimping portion 27 and the electric wire 21 whose widths are smaller than a width of the fastening portion 25 enter the escape groove 47 formed in the guide face 41. Therefore, even when the fastening portion 25 of the connection terminal 23 arrives at the fastening position, is separated from the guide face 41, and is displaced toward the fixing plate portion 51 of the terminal 15, the crimping portion 27 and the electric wire 21 that are portions of the connection terminal 23 other than the fastening portion 25 can be prevented from interfering with the guide face 41. As a result, the connection terminal 23 can be disposed in a state where the fastening portion 25 of the connection terminal 23 is in good contact with the fixing face 61 of the fixing plate portion 51 of the terminal 15.

The present invention is not limited to the embodiments described above, and may be appropriately modified, improved, and the like. In addition, materials, shapes, dimensions, numbers, arrangement positions or the like of elements in the embodiments described above are optional and are not limited as long as the present invention can be achieved.

Here, features of the embodiments of the terminal block according to the present invention described above will be briefly summarized and listed in the following [1] to [4].

[1] A terminal block (11, 11A) comprising:

a pedestal (13); and a terminal (15) attached to the pedestal (13), in which a fastening portion (25) of a counterpart terminal (connection terminal 23) is overlapped on a fixing face (61) of the terminal (15) and is fastened to a fastening position on the fixing face (61), the counterpart terminal (connection terminal 23) can be brought close to and disposed at the fastening position of the terminal (15) from a side, the pedestal (13) has a guide face (41) that guides the fastening portion (25) of the counterpart terminal (connection terminal 23) that approaches from a side upward from the fixing face (61) toward the fastening position, and the fastening portion (25) passes beyond an edge portion (43) of the guide face (41) and arrives at the fastening position so as to overlap on the fixing face (61).

According to the terminal block having the configuration of [1], the counterpart terminal can be electrically connected to the terminal by disposing and fastening the fastening portion of the counterpart terminal to the fastening position of the fixing face of the terminal. Here, in a case where the counterpart terminal is brought close to the terminal from a side, when the fastening portion of the counterpart terminal is guided above the fixing face by the guide face, passes beyond the edge portion of the guide face, and arrives at the fastening position, the fastening position of the counterpart terminal is overlapped the fixing face. Therefore, it is possible to prevent a problem that the fastening portion of the counterpart terminal comes into contact with an end face of the terminal or slips between the terminal and the pedestal, protect the terminal, and prevent an increase in costs due to formation of a chamfer or the like on the fastening portion of the counterpart terminal.

[2] The terminal block (11, 11A) according to [1], in which the guide face (41) is a tapered face that is gradually inclined upward from the fixing face (61) toward the fastening position.

According to the terminal block having the configuration of [2], the fastening portion of the counterpart terminal is guided toward the fastening position while coming into contact with the guide face formed into a tapered face that is gradually inclined upward from the fixing face toward the fastening position. Accordingly, the fastening portion of the counterpart terminal can be smoothly guided to the fastening position while being prevented from coming into contact with an end face of the terminal.

[3] The terminal block (11, 11A) according to [1], in which a height between the fixing face (61) and the guide face (41) is smaller than a step (24) provided between the fastening portion (25) and a portion of the counterpart terminal (connection terminal 23) other than the fastening portion (25).

According to the terminal block having the configuration of [3], since the height between the fixing face and the guide face is smaller than the step between the fastening portion of the counterpart terminal and the portion other than the fastening portion, when the fastening portion of the counterpart terminal is separated from the guide face and displaced toward the fixing face, the portion of the counterpart terminal other than the fastening portion can be prevented from interfering with the guide face. As a result, the fastening portion of the counterpart terminal disposed at the fastening position can be well overlapped on the fixing face of the terminal, and a fastening work can be smoothly performed.

[4] The terminal block (11A) according to [1], in which an escape groove (47) is formed in the guide face (41), and a portion of the counterpart terminal (connection terminal 23) other than the fastening portion (25) that has a smaller width than the fastening portion (25) is accommodated in the escape groove (47) in a state where the fastening portion (25) is separated from the guide face (41) and arrives at the fastening position.

According to the terminal block having the configuration of the above [4], when the fastening portion of the counterpart terminal arrives at the fastening position, is separated from the guide face, and is displaced toward the fixing face, the portion of the counterpart terminal other than the fastening portion is accommodated in the escape groove. Therefore, the portion of the counterpart terminal other than the fastening portion can be prevented from interfering with the guide face. As a result, the fastening portion of the counterpart terminal disposed at the fastening position can be well overlapped on the fixing face of the terminal, and a fastening work can be smoothly performed.

According to the present invention, it is possible to provide a terminal block capable of smoothly guiding a counterpart terminal to a fastening position and fastening the counterpart terminal while preventing an increase in costs.

What is claimed is:

1. A terminal block comprising:

a pedestal; and a terminal attached to the pedestal, wherein a fastening portion of a counterpart terminal is overlapped on a fixing face of the terminal and is fastened to a fastening position on the fixing face, wherein the counterpart terminal is guided to and disposed at the fastening position of the terminal from a side, wherein the pedestal has a guide face that guides the fastening portion of the counterpart terminal that approaches from the side and upward from the fixing face toward the fastening position, and wherein the fastening portion passes beyond an edge portion of the guide face and arrives at the fastening position so as to be overlapped on the fixing face, and wherein a height between the fixing face and the edge portion of the guide face is smaller than a step provided between a crimping portion of the counterpart terminal and the fastening portion disposed in a direction away from an axis of the electric wire compared with the crimping portion.

2. The terminal block according to claim 1, wherein the guide face is a flat surface that is gradually inclined upward from the fixing face toward the fastening position.

3. The terminal block according to claim 1, wherein an escape groove is formed in the guide face, and a portion of the counterpart terminal other than the fastening portion that has a smaller width than the fastening portion is accommodated in the escape groove in a state where the fastening portion is separated from the guide face and arrives at the fastening position.

* * * * *